US009637936B1

(12) United States Patent
Gallette et al.

(10) Patent No.: US 9,637,936 B1
(45) Date of Patent: May 2, 2017

(54) APPARATUS FOR UNROLLING ROLLS OF INSULATION IN VERTICAL STRIPS FROM THE TOP DOWN

(71) Applicants: Erik S. Gallette, Sandpoint, ID (US); Jason L. Weaver, El Dorado Springs, MO (US)

(72) Inventors: Erik S. Gallette, Sandpoint, ID (US); Jason L. Weaver, El Dorado Springs, MO (US)

( * ) Notice: Subject to any disclaimer, the term of this patent is extended or adjusted under 35 U.S.C. 154(b) by 0 days.

(21) Appl. No.: 14/967,758

(22) Filed: Dec. 14, 2015

Related U.S. Application Data

(62) Division of application No. 14/152,727, filed on Jan. 10, 2014, now Pat. No. 9,243,412.

(60) Provisional application No. 61/848,733, filed on Jan. 10, 2013.

(51) Int. Cl.

| | |
|---|---|
| ***E04F 21/18*** | (2006.01) |
| ***E04B 1/74*** | (2006.01) |
| ***E04B 1/88*** | (2006.01) |
| ***B44C 7/06*** | (2006.01) |

(52) U.S. Cl.
CPC ..... *E04F 21/1861* (2013.01); *B44C 7/06* (2013.01); *E04B 1/74* (2013.01); *E04B 1/88* (2013.01); *E04B 2001/742* (2013.01)

(58) Field of Classification Search
CPC ..... E04F 21/1861; B44C 7/06; B66F 11/04; E04B 1/88
USPC ..... 52/407.2, 407.4, 749.1, 746.1; 182/2.2, 182/2.8, 2.9; 242/594.2, 593
See application file for complete search history.

(56) References Cited

U.S. PATENT DOCUMENTS

| | | | | |
|---|---|---|---|---|
| 3,379,281 | A | 4/1968 | Calletti | 182/113 |
| 3,969,863 | A | 7/1976 | Alderman | 52/407 |
| 3,992,847 | A | 11/1976 | Heath | 52/743 |
| 4,078,355 | A | 3/1978 | Clemensen | 52/747 |
| 4,147,003 | A | 4/1979 | Alderman | 52/309.8 |
| 4,180,245 | A | 12/1979 | Anderson | 29/782 |
| 4,210,485 | A | 7/1980 | Lake | 156/577 |
| 4,261,789 | A | 4/1981 | Spataro | 156/577 |
| 4,383,398 | A | 5/1983 | Tipton | 52/743 |
| 5,495,698 | A | 3/1996 | Alderman et al. | 52/742.12 |
| 5,653,081 | A | 8/1997 | Wenrick et al. | 52/742.12 |
| 5,884,449 | A | 3/1999 | Alderman | 52/746.11 |
| 5,921,057 | A | 7/1999 | Alderman et al. | 52/746.11 |
| 6,631,602 | B2 | 10/2003 | Wagner | 52/749.1 |
| 6,769,223 | B2 | 8/2004 | Alderman | 52/749.12 |
| 6,955,018 | B2 | 10/2005 | Alderman | 52/407.4 |
| 7,527,466 | B2 | 5/2009 | Simmons | 414/10 |

(Continued)

OTHER PUBLICATIONS

"Cherry Picker," article from Wikipedia accessed online Jan. 30, 2015.

*Primary Examiner* — Joshua J Michener
*Assistant Examiner* — Alp Akbasli
(74) *Attorney, Agent, or Firm* — Jonathan A. Bay

(57) ABSTRACT

Apparatus for unrolling rolls of building insulation in vertical strips from the roof eave down, and adapted to be carried by an aerial work platform that in turn is carried by an elevator, has a pair of spars as well as an arbor and a tensioning control mechanism. The spars are spaced apart and are mounted to as well as project away from the aerial work platform. The arbor is carried between the spaced spars for inserting through the core of a role of insulation and allowing the insulation to be unrolled from the roll in the form of strips to be hung on the building. The tensioning control mechanism is provided for controlling the unrolling of the roll.

19 Claims, 6 Drawing Sheets

(56) References Cited

U.S. PATENT DOCUMENTS

| | | | | |
|---|---|---|---|---|
| 8,181,410 | B2 | 5/2012 | Stensrud | 52/407.3 |
| 8,528,301 | B1 | 9/2013 | Robbins | 52/748.11 |

APPARATUS FOR UNROLLING ROLLS OF INSULATION IN VERTICAL STRIPS FROM THE TOP DOWN

CROSS-REFERENCE TO PROVISIONAL APPLICATION(S)

This application is a divisional of U.S. patent application Ser. No. 14/152,727, filed Jan. 10, 2015, which claims the benefit of U.S. Provisional Application No. 61/848,733, of accorded filing date Jan. 10, 2013. The foregoing disclosure is incorporated herein by this reference thereto.

BACKGROUND AND SUMMARY OF THE INVENTION

The invention relates to insulation installation and, more particularly, to an apparatus for unrolling bulk rolls of insulation in vertical strips from the top down.

The inspiration for the apparatus in accordance with the invention—ie., for unrolling bulk rolls of insulation in vertical strips from the top down—comes from the construction industry. More particularly, it comes from the work done to hang the wall insulation and the cladding sheet metal thereover to pre-engineered and/or structural steel buildings.

Pre-engineered and/or structural steel buildings are a representative construction option for factories or warehouses and the like. The walls of such buildings are typically constructed of 'studs' of structural steel stood as spaced columns, or otherwise as stood in a formation referred to as a balustrade. The studs of structural steel may be heavy I-beams. This balustrade of studs typically carries multiple rows of vertically spaced cross members, which are typically called wall 'girts.' (Their counterparts running across the roof are typically called 'purlins,' but sometimes the usage between the two terms is mixed.) In the case of pre-engineered steel buildings, the wall girts typically comprise cold roll sheet metal formed into C-shaped channels (or Z-shapes and so on). The wall girts for structural steel buildings are much more heavy duty, like C-shaped channels in schedule 40 grade.

A common height for the walls of these buildings is 107 feet high (~32 m high) (and, these buildings will be even taller at the crown of the roofs). The wall girts can be spaced apart anywhere between about two feet apart in elevation to seven feet (between about ~0.6 m and ~2.1 m). The spacing between wall girts is specified by the design plans and depends on such design factors as wind load and so on. Customarily, the typical spacing between wall girts is about five feet apart (~1.5 m). Insulation is applied in vertical strips to the outside of these wall girts in strips typically in widths anywhere between about (and without limitation) four and six feet (~1.2 to ~1.8 m). An example of the manner of how this insulation is hung according to the prior art includes the following.

One serious challenge to hanging insulation like this is, the wind. Even a moderate wind will frustrate or complicate the job for the installers at every step of the process. The conventional way of hanging this insulation is to quilt the insulation together in small pieces. Twenty-five foot long or so (~7.6 m) strips of insulation are cut off stock rolls that are six foot laterally wide or so (~1.7 m wide) and maybe have a plush thickness or depth of six inches or so (~0.15 m). It is also conventional to, deploy boom loaders to do this work. And not just one, but a tandem of two. Each boom loader supports an aerial work platform at the end of a telescopic or articulating boom. Both of the two boom loaders are conventionally crewed by a two person crew. The crews of the two boom loaders work in concert to handle and hang each small strip, one strip at a time. In addition to those four personnel in the boom loaders, a ground assistant works non-stop to serially supply the crews of the boom loaders with the many small strips.

The small strips are hung by having their top edges attached first. So for a short time-being, the whole weight of the strip is carried only by the attachment along its top edge alone. However, as soon as the crew can get around to it, the strip is fastened with back-up attachments at several more belts at elevations below its top edge. One reason to keep the strips under twenty-five feet or so (~7.6 m) is:—so that the strips just don't tear apart (for the short time-being while hung from their top edges only) under the force of their own weight. Another reason is to combat the wind from making the strips overly crooked or billowed (eg., in full sail) when fastened. That is, the effect of wind tends to make the fastened strip not straight or else warped out between the left and right sides.

The small strips have to meet at splices at the short top and bottom ends to attain the full one-hundred and seven feet height (~32 m height) of the wall. The small strips have to meet at splices along the long left and right sides with neighboring strips. The more seamless and neat the splices are, the better climate barrier the quilt-work of insulation serves as a whole for the building.

It is a problem for the insulation crew that, even when five workers strong, the insulation crew is barely able to stay ahead of the sheet metal cladding crew because of the work of splicing together so many small strips of insulation.

Given the foregoing, while insulation is hung this way according to the prior art, there are certain undesirable outcomes. One is, keeping the strips straight is difficult. Two is, splicing one not quite straight strip to another not quite straight strip is also difficult, especially when the two strips are on even just slightly different slants. Three is, the edges seldom meet up seamlessly . . . and so on.

The splices are visible from the inside of the building. Not only that but, the splices are visible from the inside of the building—for the life of the building. However, the horizontal splices between the ends of the small strips are particularly unsightly. And, the horizontal splices only become more unsightly as the building ages. As time extends, the vinyl covering for the insulation (which serves as the interior surface of the outer walls of the building), often (very often) becomes covered with a film of grime. For a variety of reasons, the grime collects more intensely around the splices at the horizontal seams between the ends of such strips. It is not known if the horizontal seams between the ends of such strips serve as shelves or ledges to intensify the collection of such grime.

Regardless, those portions of the splices just become more unsightly over time.

What is needed is a solution over the shortcomings of the prior art.

It is an object of the invention to overcome the shortcomings of the prior art.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figure 1:
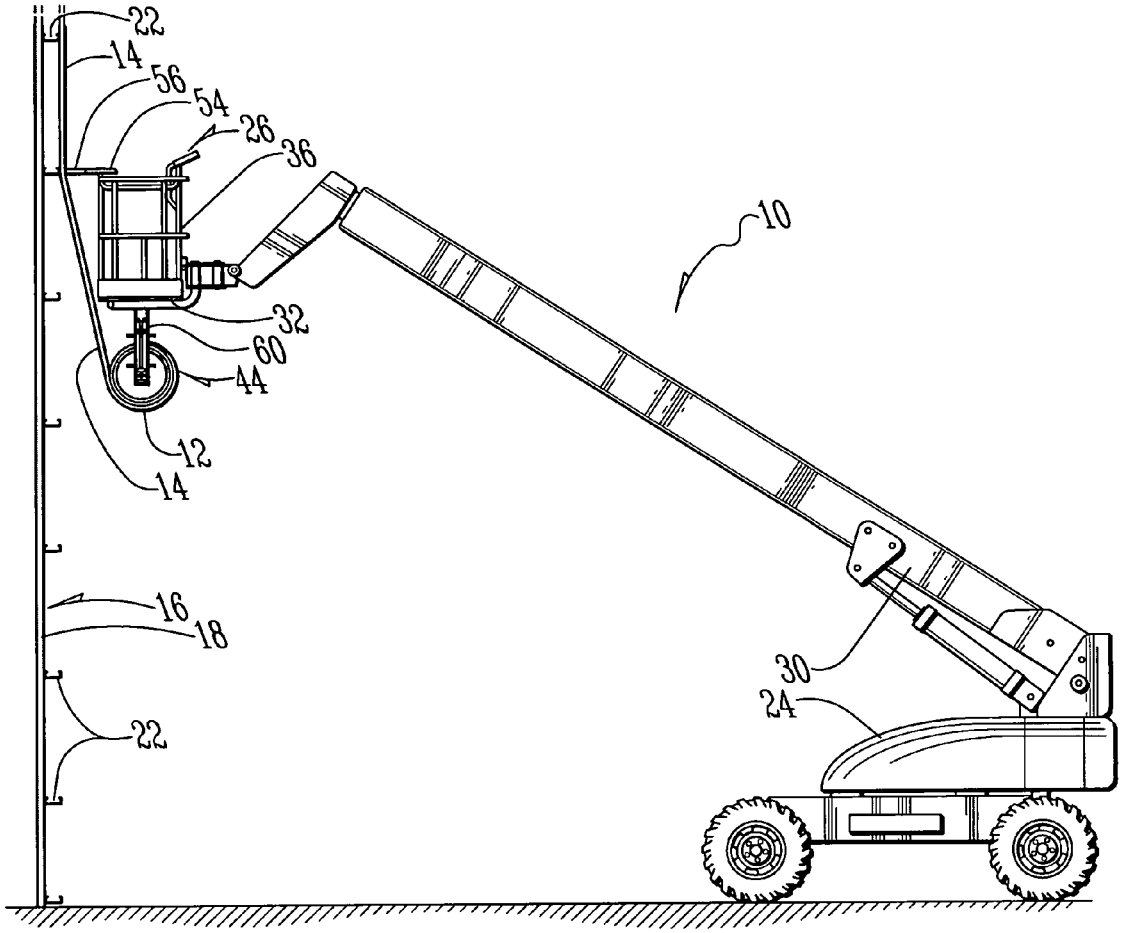
FIG. 1 is a side elevation view of apparatus in accordance with the invention for unrolling bulk rolls of insulation in vertical strips from the top down, wherein the outside wall of a structural or pre-engineered steel building is shown as an example operative use environment.

FIG. 1 shows apparatus 10 for unrolling bulk rolls 12 of insulation in vertical strips 14 from the top down. The work environment which inspired the invention comprises insulation installation on structural and pre-engineered steel buildings 16. However, the applicability of the invention is in no way limited to such use environments or otherwise exclusively to unrolling rolls 12 of insulation.

Pre-engineered steel buildings 16 are a representative construction option for factories and/or warehouses, and as example and without limitation of potential uses for such buildings 16. The wall of such a pre-engineered steel building 16 is typically constructed of columns of 'studs,' or a balustrade, of structural steel. The structural steel may be heavy I-beams. FIG. 1 illustrates just as much as the outboard flange(s) 18 of structural I-beams, wherein the web and inboard flange(s) are not shown. This balustrade of studs (eg., the outboard faces of which are indicated by reference numeral 18) typically carries multiple rows of vertically spaced cross members, which in the case of pre-engineered steel buildings 16 typically comprise C-shaped wall girts 22. The wall girts 22 are typically formed of cold roll sheet metal. However, once the C-shaped wall girts 22 are oriented for fastening on the balustrade of studs, they take on a U-shaped orientation. Other shapes are known, for example and without limitation, Z-shaped and so on.

The foregoing describes the preparation of a structure which is representative without limitation for the applicability of the insulation unrolling apparatus 10 in accordance with the invention.

Such structures ought to be and typically are insulated with a layer of insulation before the final exterior skin is affixed (eg., sometimes which final exterior skin is referred to as the sheet metal 'cladding').

The apparatus 10 comprises a boom loader 24,26,30 comprising a ground vehicle 24 supporting an aerial work platform 26 at the end of a telescopic or articulating boom 30. The boom 30 can be extended and foreshortened, and tilted through a range of angles from nearly horizontal to nearly vertical. The work platform 26 comprises a floor 32, a kick plate 34, and a worker basket 36 having a rim formed as a hand rail 38. The work platform 26 includes a control console 42 for driving and/or otherwise operating the controls of the boom loader 24,26,30.

A boom loader 24,26,30 is shown for example only and is not the only means that will work to accomplish the objects of the invention in regards of elevating an aerial work platform. Other suitable lifting means certainly include cranes, and, for some low height buildings perhaps telescoping reach fork lifts (eg., the 'elevator' for the work platform).

Suspended below the level of the floor 32 of the work platform 26 is a roll dispenser 44 in accordance with the invention. With reference to FIGS. 2 through 5, the roll dispenser 44 comprises a spaced pair of legs 46 (or stiles or spars). The legs 46 themselves might be produced from C-shaped steel channel pieces hung from hanger hardware 48 from underneath the aerial work platform 26. Preferably the legs 46 are spread apart approximately the width of the rolls 12 to be hoisted. Typically and without limitation this would be between four and one-half to six and one-half feet (~1.4 to ~2.0 m).

Figure 5:
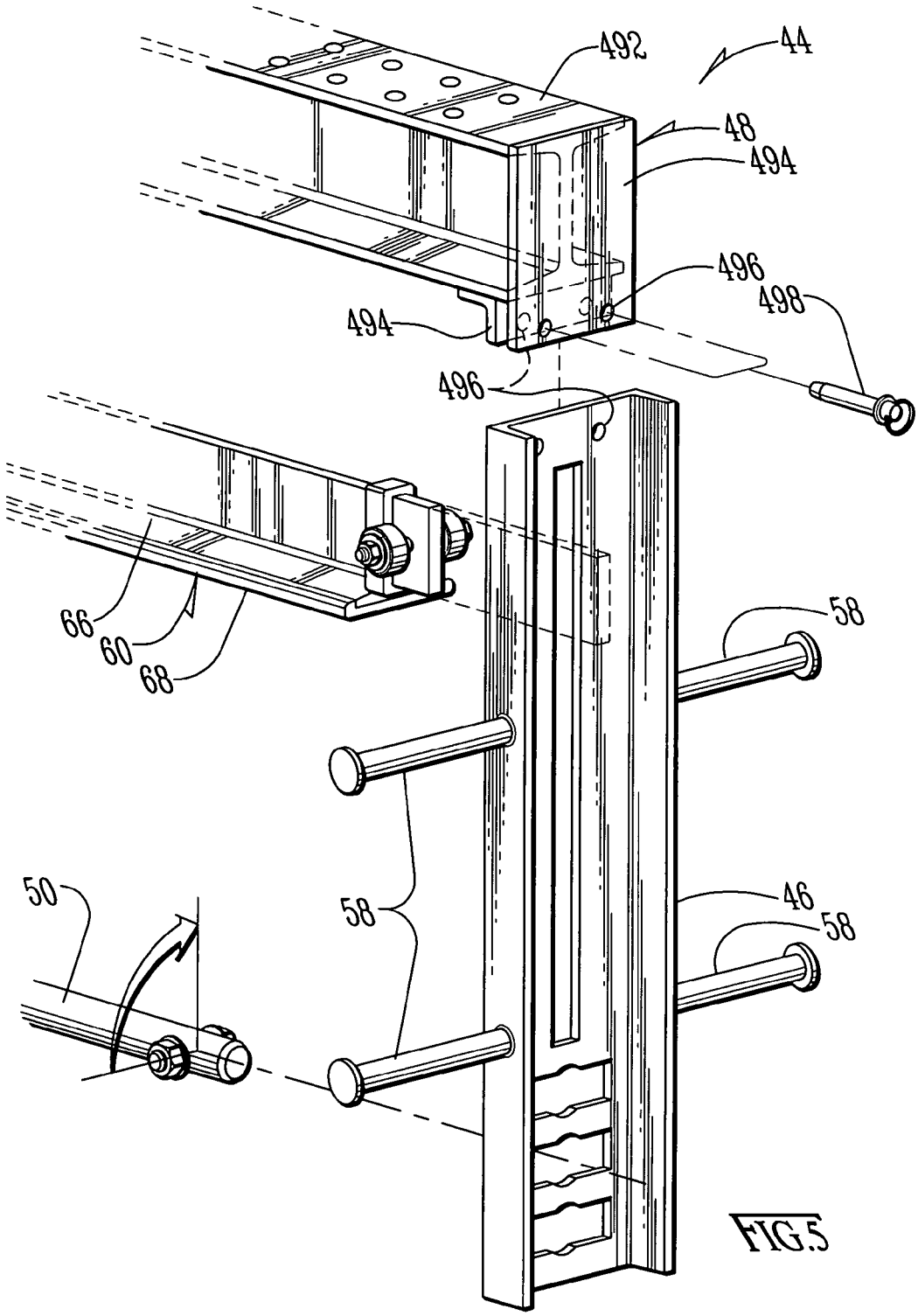
FIG. 5 is an enlarged scale exploded view taken from FIG. 4 and showing the framework of one of the two sides of the roll dispenser in accordance with the invention, with other portions broken away.

As FIG. 5 shows better, the hanger hardware 48 comprises for example and without limitation an I-beam 492 more or less permanently mounted under the floor 32 of the work platform 26. The mounting of the I-beam 492 can be accomplished by bolts, or welding, and so forth. Welded to the very end of the I-beam 492 is a plate, and then also, welded to fairly near the end of the I-beam 492 is an angle piece. The plate and angle piece are arranged and spaced apart to form a pair of opposed flanges 494. As mentioned above, the legs 46 of the roll dispenser 44 are C-shaped steel channel pieces which, accordingly, have web portions. The upper end of the web portions of the legs 46 insert between the spaced flanges 494 of the hanger hardware 48 until a pattern of holes 496 align (which pattern 496 is common to both flanges 494 and the web portion of the legs 46). A pair of quick connnect/disconnect pins 498 insert through these holes 496 and thus secure the legs 46 suspended from the hanger hardware 48. Given the foregoing, a single worker can quickly hang the roll dispenser 44 in accordance with the invention from underneath the aerial work platform 26 in order to perform insulation installation in accordance with the invention. Later, perhaps the next day or another day, the single worker can just as quickly dismount the roll dispenser 44 in accordance with the invention from the aerial work platform 26. That way, the aerial work platform 26 is freed to be put to other uses without the unneeded roll dispenser 44 being an encumbrance.

Spanning across the legs 46 near the bottom ends of the legs 46 is an arbor 50. The arbor 50 is optionally pinned both inside and outside of each leg 46 to prevent the legs 46 from either spreading further apart or pinching the roll 12. However, perhaps only the outside pins or, if the legs 46 are stiff enough, the inside pins are truly necessary. (Moreover, this function of trapping the legs both on the inside and outside of each leg by a cross bar, and in order to prevent unwanted spreading or pinching, can be performed by another cross bar. Namely, such as a tensioning control mechanism 60 more particularly described below.)

Figure 2:
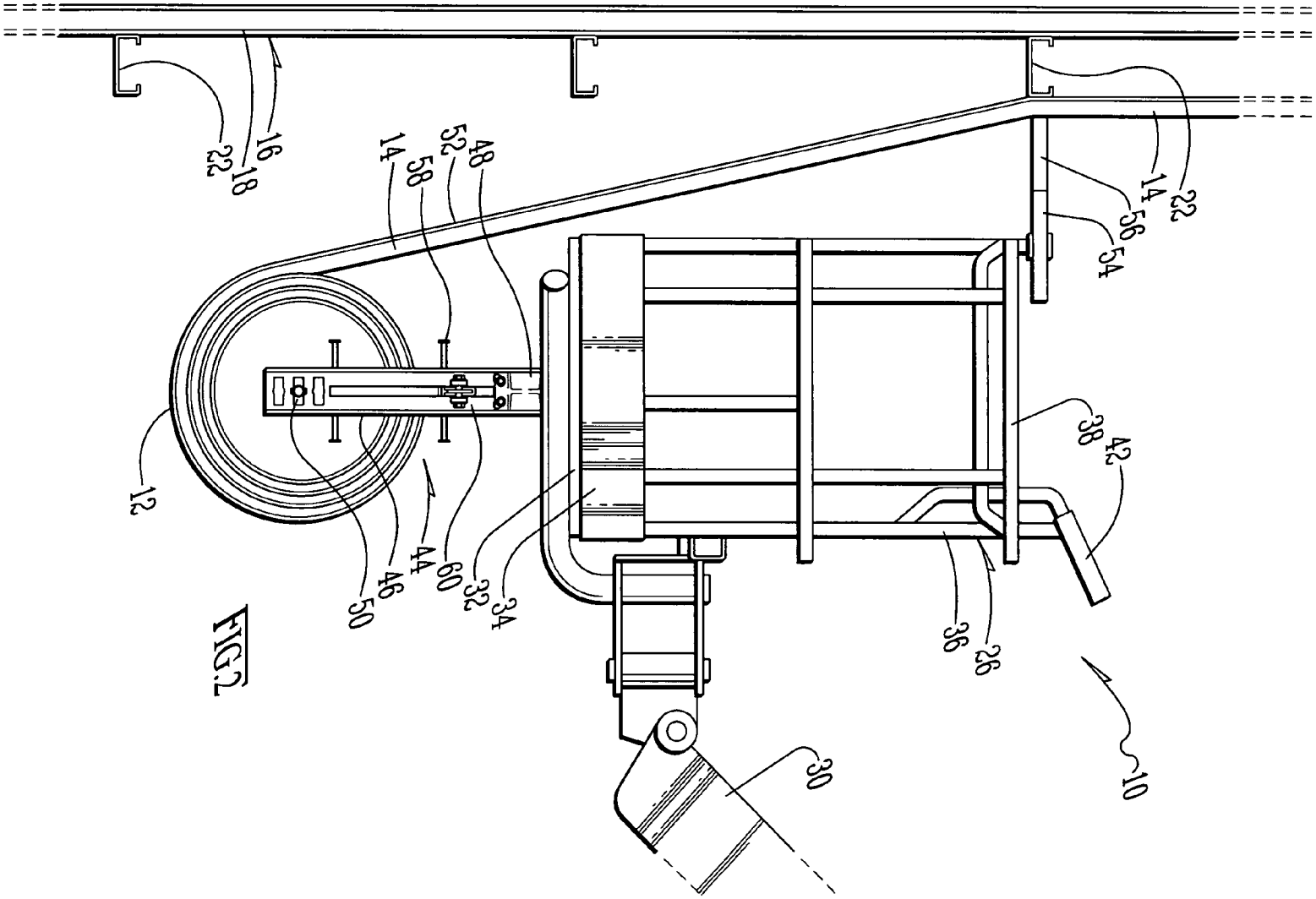
FIG. 2 is an enlarged-scale side elevation detail view in connection with detail of the aerial platform at the end of the boom in FIG. 1, with the vehicle portion of the boom loader and then also portions of the wall of the building removed from view.

FIG. 1 shows a roll 12 loaded onto the arbor 50 and hoisted aloft. Typical rolls 12 of insulation comprise a rolled up strip 14 of fiberglass insulation which might have a nominal thickness of 3½ inches, 5½ inches and onward to even greater thicknesses (eg., ~9 to ~14 cm and onward). One of the two broad faces (ie., not the edges) will be covered by a backing material 52. This can be anything from a polymer film, to a geotextile, to a paper product and so on. The roll 12 is usually rolled such that the backing material 52 is on the outside of the roll 12 (the backing material 52 will actually become interior surface of the outer walls of the building 16). Hence as shown in FIGS. 1 and 2, the backing material 52 is applied directly up against the wall girts 22.

The hand rail 38 of the basket 36 carries another 'wound-up' winding of material, this time, a spool 54 of steel or poly banding material 56 supported on a spindle about a vertical axis (the steel banding used for fastening insulation like here in this use environment is a much softer material than the hard stuff used on, for example, lumber).

Pause can taken now to introduce a manner of use of the apparatus 10 in accordance with the invention. Fresh rolls 12 of insulation might be brought to the job site in van trucks (or perhaps semi-trailers), with the rolls 12 laying on their sides, and with a hollow cardboard or plastic tube defining the core 57 of the roll 12.

It is an aspect of the invention that the insulation work for insulating structural and/or pre-engineered steel buildings 16 can be performed by a single worker:—again, not a crew of five as in accordance with the prior art, but, a single worker. Moreover, with planing, the single worker can work faster (eg., get more done in less time) than the crew of five does, operating in accordance with prior art practices.

Here, the worker is expected to do a little planning ahead (albeit the planning function is performed by others for the worker). Typically, the planning involves the following various factors. Assume the construction site is operating on single shift days. That is, the insulation worker and the cladding crew coming behind him or her are going to work a single shift, and then knock off to return to work on the next business day. Why a 'day' or 'shift' matters is because the insulation is preferably not left exposed to the elements overnight, whether that be rain or just dew. The consequences of the preference is two fold. Preferably no rolls of insulation intended to be hung the next day are left outside overnight. Preferably all insulation hung on the building in a shift is covered by the cladding to before the end of the shift, or nightfall.

Given the foregoing, the first calculation involves estimating how many rolls the job will require. The second calculation involves estimating how many rolls can be hung—and covered over by cladding—in a day. If the job is going to be a several day job, then the worker wants to have on hand for each day at least about as many rolls he or she will have to hang that day.

Let's assume the worker is going to have a day's worth of insulation rolls brought to the job site in a single day. Let's further assume that this is some difference between which rolls which be hung first, and which will be hung last. The worker preferably wants the rolls that will be hung last loaded first into the van (or semi-trailer or whatever). Correspondingly, the worker preferably want the rolls that will be hung first loaded last in the van.

That way, at the beginning of the day, the worker can access at the back of the van the rolls that will be hung first. Optionally, the worker operates a fork lift to unload the rolls out of the van, and, distribute the rolls around the job site. Let's assume the rolls are 250 feet long (~76 m), six foot wide (~1.8 m), and are going to be hung in 107 foot high (~32 m) strips on the outside of the building. That means the following. One roll will provide two such strips before being spent. Thus, a new roll will be required every twelve feet. Thus, the worker preferably distributes the rolls at every twelve linear feet (~3.6 m) of wall length.

The rolls are preferably left on cylindrical sides, eg., the core 57 of the roll is extending horizontally, parallel to the ground. That way, the worker plucks up the first roll, dispenses two strips on the building side before the roll is spent. Then the worker does the following operation. Since the worker has just completed the second strip out of the first roll, the first roll must be fairly close to the ground (if not already on the ground). With the spent first roll resting on the ground, the worker climbs out of the basket 36, undoes the arbor 50, and thereby has cut loose the first roll. The worker operates the boom loader 24,26,30 (perhaps with ground controls on the vehicle portion 24 thereof) to straddle the legs 46 of the dispenser 44 alongside the second roll (which is resting on the ground). The worker next slides the arbor 50 through the core 57 of the roll. And thus the worker is back in business with the second roll.

Figure 3:
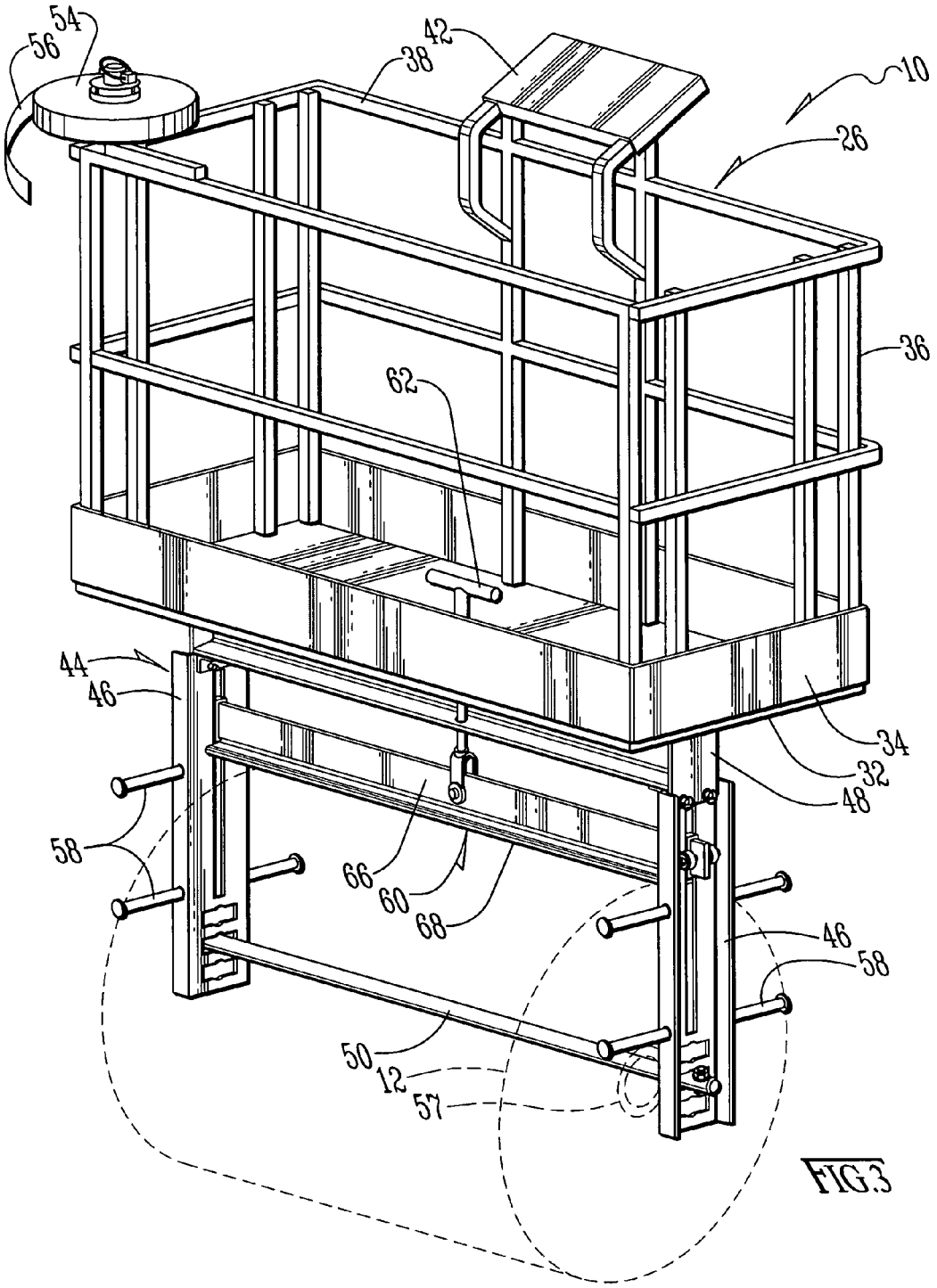
FIG. 3 is a perspective view of FIG. 2, with the wall of the building and boom of the boom loader removed from view.
Figure 4:
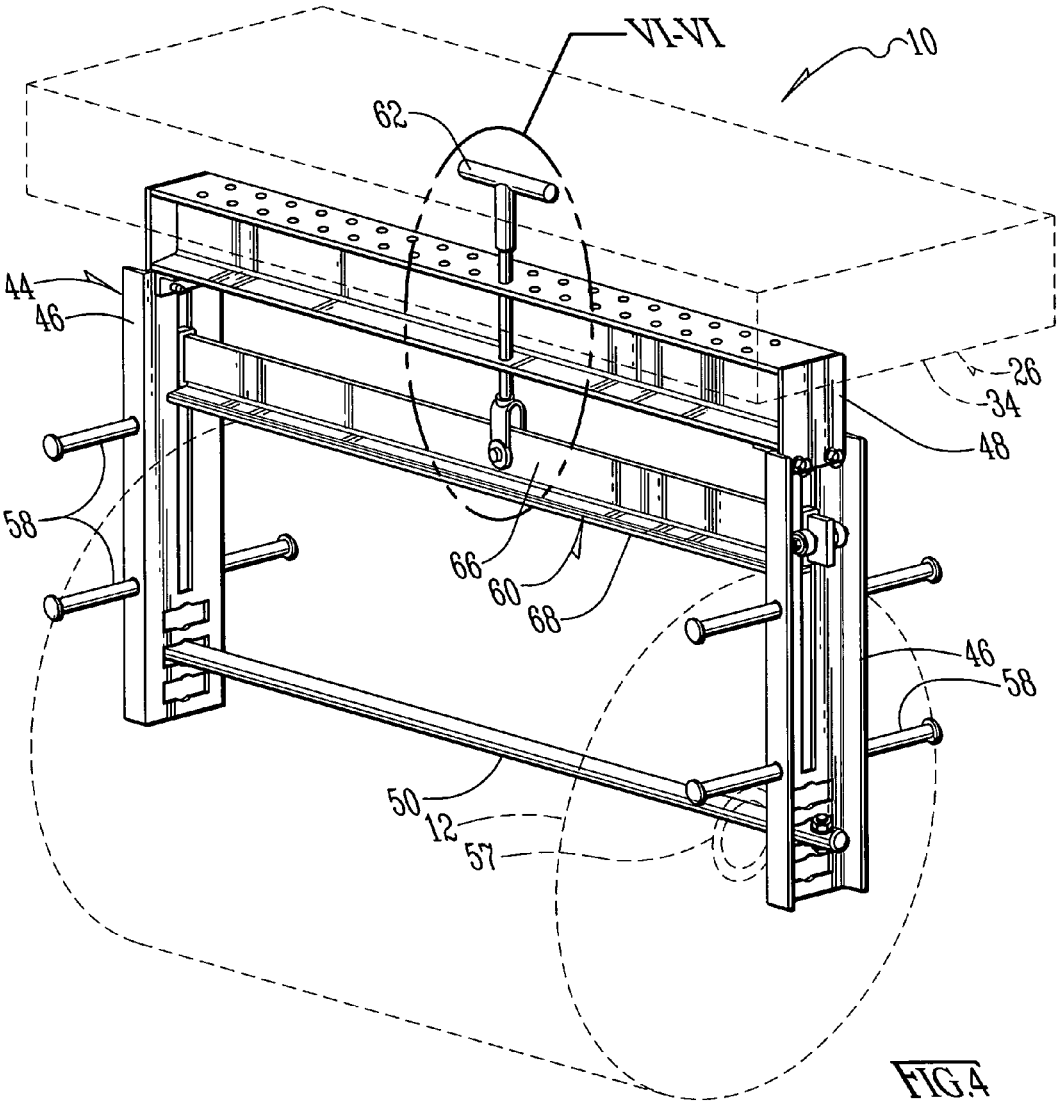
FIG. 4 is a perspective view comparable to FIG. 3 except showing an insulation roll having a larger radius than the insulation roll in FIG. 3 and to better show aspects of the tensioning control mechanism in accordance with the invention.

Pause can be taken to describe in a little more detail how to load a roll 12 into the dispenser 44. Presumptively, the boom loader 24,26,30 starts off in the position with the legs 46 of the roll dispenser 44 standing on the ground. A user would withdraw the arbor 50 and presumptively set it aside on the floor 32 of the aerial work platform 26. Then the user would climb into the basket 36 of the aerial work platform 26 by the ladder rungs 58 attached to one of the legs 46 of the roll dispenser 44 (none of this is shown, but ladder rungs 58 are shown in FIGS. 3 through 5).

The user would drive the boom loader 24,26,30 and operate the boom 30 in order orient the legs 46 of the roll dispenser 44 to straddle one roll 12. Then the user would climb down the ladder rungs 58, step off onto the ground, and secure the arbor 50 through the core 57 of the roll 12. Now the user can lift the roll 12 by the stick boom 30. The user only wants to lift the roll 12 just a small gap off the ground, and start to unroll the roll 12 of insulation and pull out the lead edge of the roll 12, which becomes the head of the strip 14. The user lines up the head with the handrail 38 of the basket 36. The user fixes the head there with adhesive, or clamps or anything.

A little further pause can be taken to describe in a little more detail how to hang one strip 14 of insulation by means of the dispenser 44. The user starts to drive the stick boom vehicle 24 to wherever he or she wants the vehicle 24 to be in order to orient the boom 30 and aerial work platform 26 in a proper place to attach the first strip 14 (of at least from this newly taken onboard roll 12). The user elevates the basket 36 to the eave strut or purlin of the building 16, the roof edge or like highest elevation for attachment of the strip 14. The user attaches the head of the strip 14 to the building 16, by any number of ways. The user may apply double-sided adhesive tape to the eave strut purlin of the roof, and then sticks the head of the strip 14 to the adhesive too. The user may drive three to six self-tapping screws (or fasteners) along a row into an eave strut or purlin (or whatever the upper attachment member is). The user might optionally cut three short tabs of banding material 56 (about six inches long, or ~0.15 m), and then secure on end of the head with two screws and a tab, about the middle of the head with two screws and a tab, and then secure the other end of the head with the last tab and two screws. By whichever way the user gets the head of the strip 14 to start off being held to the roof eave or purlin, the user thereafter wants to come back over that row with a whole belt of the banding material 56. Alternatively, the user may try to directly attach the head of the strip 14 with a whole belt of banding material 56, but that is often hard to do by a single person.

Eventually, the user will have wanted to pull about six to seven linear feet (~1.8 to ~2 m) of the banding material 56 off the spool 54. This length of banding material may be referred to as a 'belt.' The user ultimately completes the fastening of the head of the strip 14 by driving self-tapping screws or the like through the belt of banding material 56 and the head of the insulation strip 14 to sink into the eave strut or purlin (or roof edge) of the building 16. The user then severs the fastened banding material 56 from the rest of the spool 54. Hence the first 'belt' is left behind.

The majority of the weight of the roll 12 of the insulation is carried by the dispenser 44 device hung underneath the basket 36. The top band only has to carry about five to fifteen linear feet (~1.5 to ~4.5 m) of the weight of the strip 14. Then the user lowers the basket 36 to attach a second length ('belt') of banding material 56 across the strip 14 at some lower wall girt 22. And so on, successively, fastening a length ('belt') of banding material 56 across the strip 14 successively at each 'chosen' wall girt 22 from the top to bottom, lowering the stick boom 30 after finishing each 'chosen' wall girt 22.

To call any wall girt 22 a 'chosen' wall girt 22 means the following. Assume the wall girts 22 are spaced at elevations five feet apart (~1.5 m). Assume also that the installation is taking place on a fine windless day. The worker might belt the strip 14 at the head thereof, and then at every fifteen feet (~4.5 m) spacing after that. The belts are not intended to support the strip 14 for the life of the building 16. Instead, the belts are intended to only support the strip 14 for the length of time it takes the cladding crew to come back over and attach the exterior sheet metal skin of the building 16. In contrast to a windless day, a windy day may force the worker to belt the strip 14 with banding material 56 at every wall girt 22 (ie., every wall girt 22 is a 'chosen' wall girt 22).

Various advantages of the invention include the following. Strips 14 of insulation in lengths of easily one-hundred feet or longer (~ greater than thirty meters) can be fastened to buildings 16 in one single strip, without one or more splices in the middle. Moreover, the invention gives the user the opportunity to continue to work in windy conditions like never before, ie., the opportunity to apply insulation strips 14 in windy conditions. Furthermore, the invention provides a single worker with the ability to handle full rolls 12 of insulation and hang the insulation in strips 14, without dependence on any help from anybody else. In other words, the invention replaces the usual crew of five or so workers with a crew of just one.

To turn to FIGS. 3 through 7, the roll dispenser 44 includes a tensioning control mechanism 60. The tensioning control mechanism 60 comprises a brake pedal 62, a drive shaft 64, a shoe 66 formed of a heavy gauge steel T-beam, and, a non-slip lining 68 on the shoe 66 to frictionally brake the backing material 52 of the insulation roll 12. The non-slip lining 68 might comprise neoprene or a like resilient material. The drive shaft 64 might extend through a bushing in the basket 36's floor 32 which is likewise lined with neoprene or the like to prevent creep after the brake has been set.

Given the foregoing, the tensioning control mechanism 60 allows the user to prevent—from a standing posture within the basket 36—the insulation roll 12 from freely unrolling unchecked and hence sending a backlash of the insulation roll 12 cascading to the ground. Additionally, the tensioning control mechanism 60 gives the user control over the unrolling of the insulation roll 12 as the stick boom 30 lowers from high elevation to low elevation.

Figures 6, 7:
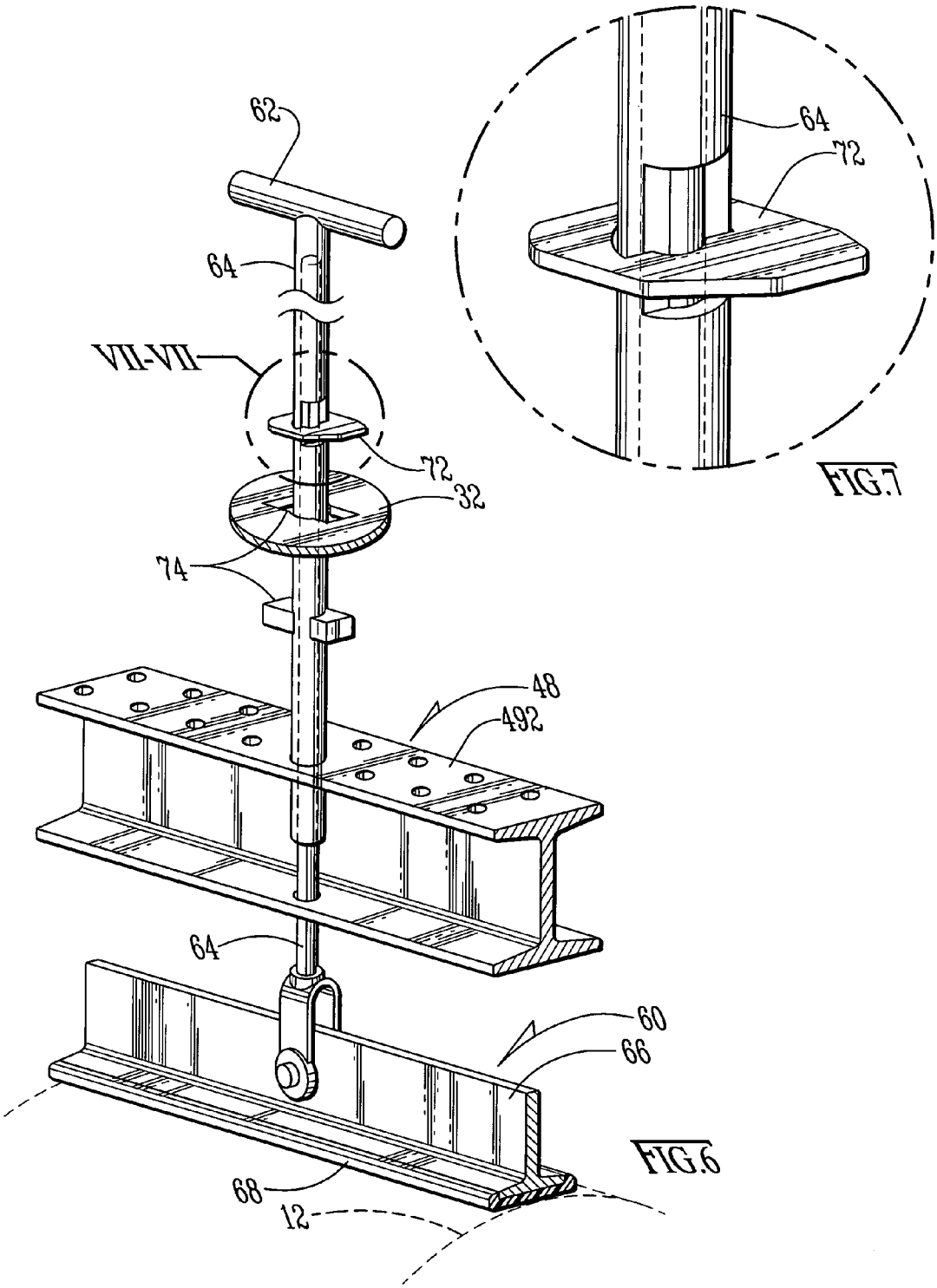
FIG. 6 is an enlarged scaled perspective view of detail VI-VI in FIG. 4.
FIG. 7 is an enlarged scaled perspective view of detail VII-VII in FIG. 6.

FIGS. 6 and 7 show better that the drive shaft 64 of the tensioning control mechanism 60 is telescopic. A lower and inner sleeve slides inside an upper and outer sleeve. The purpose for making the drive shaft 64 telescopic is for adjusting its length during use. FIGS. 3 and 4 show the dispenser 44 loaded with a fresh roll 12 of insulation. As strips 14 are installed on the building, the roll 12 will shrink such that is loses twenty inches in diameter (~0.5 m). That means the drive shaft 64 of the tensioning control mechanism 60 will have to start out with the actual pedal 62 at least twenty inches above the surface of the floor 32 of the work platform 26. Such a high elevation would make the pedal 62 unmanageably too high for some users.

However, the drive shaft 64 is telescopic. The user can start with the drive shaft 64 foreshortened such that the pedal 62 is about eight inches (~0.2 m) off the floor 32. Then as the user plunges the pedal 62 closer and closer to the floor 32, the user can hook his or her foot under the pedal 62 and lengthen the drive shaft 64 until the pedal 62 is another eight inches (~0.2 m) off the floor 32 or so. The telescopic sleeves of the drive shaft 64 have a one-way mechanism 72 which allows the sleeves to slide fairly freely when being pulled apart in extension from each other. But otherwise the one-way mechanism 72 remains relatively latched when the sleeves are driven in foreshortening strokes.

FIG. 7 shows better that the one-way mechanism 72 may comprise a simple mechanism sometimes known as a closer slide, or hold open clip, and which are common on the piston rod of the door-closing cylinder of patio screen doors.

FIG. 6 shows better that the tensioning control mechanism 60 includes a brake parking provision 74 to park the brake shoe 66—not tight against a roll 12—but in an upper and slack position. That way, a single user can load in a new roll 12 without the brake shoe 66 getting in the way. The brake parking provision 74 comprises a pair of tabs secured on the drive shaft 64 and a key hole in either the floor 32 of the platform 26 (or else a keyhole in the hanger hardware 48). A user can pull the shoe 66 up until the ears pass through the key hole, and then twist the shaft 64 so that ears are oriented to where the ears cannot pass through the keyhole.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A method for hanging vertical strips of building insulation from rolls from an upper attachment position that is adapted to be controlled by a single worker, and where the width of said rolls are capable of being greater than a height of the single worker; said method comprising the steps of:

providing an aerial work platform for said single worker to work from;

providing the aerial work platform with a top end and a base end and wherein a pair of spaced spars extend between opposing terminal end portions of said base end, and are mounted relative to the aerial work platform and terminal ends, the spars mounted to project away from the aerial work platform such that the spars can be dropped down to pluck up one of said rolls of building insulation whereby the spaced terminal ends straddle opposite ends of said one roll;

providing an elevator for carrying the aerial work platform at least between the extremes of a ground level and said upper attachment position;

plucking said roll of said building insulation from a support surface wherein a hollow core therethrough is oriented generally horizontal, elevating said roll to the upper attachment position;

attaching a leading edge of said roll to the upper attachment position; and progressively attaching belts across multiple rows of vertically spaced attachment positions down to ground level while unrolling the roll in a strip relative to a building.

2. The method of claim 1, wherein:

plucking said roll comprising straddling said roll with said spars and spooling said roll with an arbor that transits provisions for the spar proximate said terminal ends of the spars and the core of said roll straddled therebetween.

3. The method of claim 1, further comprising:

applying a tensioning control mechanism to prevent unwanted unrolling of said roll.

4. The method of claim 1, further comprising:

a plurality of said roll, distributing said plurality of said rolls of said building insulation across a job site according to a distribution wherein a succeeding roll is placed by where a preceding roll will be spent and cut loose for replacement.

5. The method of claim 4, wherein:

each roll is in excess of 200 feet long and has a width (W), and is to be applied in strips on said building in excess of 100 foot long strips, whereby each roll will provide two such strips before being spent;

said step of distributing further comprising distributing the plurality of said roll in a distribution along the length of a wall spaced apart about every twice times width (W).

6. The method of claim 1, further comprising:

providing said aerial work platform with a floor, worker-basket and work rail; and providing controls accessible for said single worker inside the worker-basket for driving or controlling the controls of the elevator.

7. The method of claim 6, further comprising:

providing a foot-operator for said tensioning control mechanism allowing said single worker to be capable to operate the tensioning control mechanism by foot.

8. The method of claim 6, wherein:

the step of plucking said roll of said building insulation from a support surface further comprises attaching a leading edge of said roll temporarily to said work rail; and the step of progressively attaching belts across multiple rows of vertically spaced attached positions further comprises providing one of the work rail or worker-basket with a supply of belting material.

9. The method of claim 6, wherein:

the step of plucking said roll of said building insulation from a support surface further comprises providing said spars with rungs or treads for said single worker to travel back and forth between said aerial work platform and said support surface.

10. The method of claim 9, further comprising:

providing hanger hardware comprising a plurality of quick connection coupling mechanisms for allowing said spars and said aerial work platform to be connected and freed.

11. A method for hanging vertical strips of building insulation from rolls from an upper attachment position that is adapted to be controlled by a single worker, and where the width of said rolls are capable of being greater than a height of the single worker; said method comprising the steps of:

providing an aerial work platform for said single worker to work from;

providing the aerial work platform with a top end and a base end and wherein a pair of spaced spars extend between opposing terminal end portions of said base end, and are mounted relative to the aerial work platform and terminal ends, the spars mounted to project away from the aerial work platform such that the spars can be dropped down to pluck up one of said rolls of building insulation whereby the spaced terminal ends straddle opposite ends of said one roll;

providing an elevator for carrying the aerial work platform at least between the extremes of a ground level and said upper attachment position;

plucking said roll of said building insulation from a support surface wherein a hollow core therethrough is oriented generally horizontal, said plucking comprising straddling said roll with said spars and spooling said roll with an arbor that transits provisions for the spar proximate said terminal ends of the spars and the core of said roll straddled therebetween;

applying a tensioning control mechanism to prevent unwanted unrolling of said roll;

elevating said roll to the upper attachment position;

attaching a leading edge of said roll to the upper attachment position; and progressively attaching belts across multiple rows of vertically spaced attachment positions down to ground level while unrolling the roll in a strip relative to a building.

12. The method of claim 11, further comprising:

a plurality of said roll, distributing said plurality of said rolls of said building insulation across a job site according to a distribution wherein a succeeding roll is placed by where a preceding roll will be spent and cut loose for replacement.

13. The method of claim 12, wherein:

each roll is in excess of 200 feet long and has a width (W), and is to be applied in strips on said building in excess of 100 foot long strips, whereby each roll will provide two such strips before being spent;

said step of distributing further comprising distributing the plurality of said roll in a distribution along the length of a wall spaced apart about every twice times width (W).

14. The method of claim 11, further comprising:

providing said aerial work platform with a floor, worker-basket and work rail; and providing controls accessible for said single worker inside the worker-basket for driving or controlling the controls of the elevator.

15. The method of claim 14, further comprising:

providing a foot-operator for said tensioning control mechanism allowing said single worker to be capable to operate the tensioning control mechanism by foot.

16. The method of claim 14, wherein:

the step of plucking said roll of said building insulation from a support surface further comprises attaching a leading edge of said roll temporarily to said work rail.

17. The method of claim 16, wherein:

the step of progressively attaching belts across multiple rows of vertically spaced attachment positions further comprises providing one of the work rail or worker-basket with a supply of belting material.

18. The method of claim 14, wherein:

the step of plucking said roll of said building insulation from a support surface further comprises providing said spars with rungs or treads for said single worker to travel back and forth between said aerial work platform and said support surface.

19. The method of claim 18, further comprising:

providing hanger hardware comprising a plurality of quick connection coupling mechanisms for allowing said spars and said aerial work platform to be connected and freed.

* * * * *